US005948465A

United States Patent [19]

Blanchet-Fincher et al.

[11] Patent Number: 5,948,465

[45] Date of Patent: Sep. 7, 1999

[54] PROCESS FOR MAKING A FIELD EMITTER CATHODE USING A PARTICULATE FIELD EMITTER MATERIAL

[75] Inventors: Graciela Beatriz Blanchet-Fincher, Greenville; William Leo Holstein, Wilmington; Shekhar Subramoney, Hockessin; Norman Herron, Newark, all of Del.

[73] Assignee: E. I. du Pont de Nemours and Company, Wilmington, Del.

[21] Appl. No.: 09/068,484

[22] PCT Filed: Nov. 13, 1996

[86] PCT No.: PCT/US96/18145

§ 371 Date: May 12, 1998

§ 102(e) Date: May 12, 1998

[87] PCT Pub. No.: WO97/18577

PCT Pub. Date: May 22, 1997

Related U.S. Application Data

[60] Provisional application No. 60/006,747, Nov. 15, 1995.

[51] Int. Cl.[6] ..... B05D 5/12; H01J 9/02

[52] U.S. Cl. ..... 427/77; 427/226; 427/435; 427/436; 427/125; 445/50; 445/51

[58] Field of Search ..... 427/77, 78, 125, 427/226, 435, 436; 445/50, 51

[56] References Cited

U.S. PATENT DOCUMENTS

| | | | |
|---|---|---|---|
| 4,857,799 | 8/1989 | Spindt et al. | 313/495 |
| 5,015,912 | 5/1991 | Spindt et al. | 313/495 |
| 5,129,850 | 7/1992 | Kane et al. | 445/24 |
| 5,199,918 | 4/1993 | Kumar | 445/50 |
| 5,578,901 | 11/1996 | Blancher-Fincher et al. | 313/496 |
| 5,616,368 | 4/1997 | Jin et al. | 427/535 |
| 5,619,093 | 4/1997 | Glesener et al. | 313/309 |

FOREIGN PATENT DOCUMENTS

| | | |
|---|---|---|
| 0 712 146 A1 | 5/1996 | European Pat. Off. . |
| WO 91 05361 | 4/1991 | WIPO . |
| WO 94 15350 | 7/1994 | WIPO . |
| WO 94/15352 | 7/1994 | WIPO . |
| WO 94 28571 | 12/1994 | WIPO . |
| WO 95/22169 | 8/1995 | WIPO . |
| WO 96 00974 | 1/1996 | WIPO . |
| WO 97/18575 | 5/1997 | WIPO . |
| WO 97/18576 | 5/1997 | WIPO . |

OTHER PUBLICATIONS

L. A. Chernozatonskii, et al., Electron Field Emission From Nanofilament Carbon Films, *Chemical Physics Letters,* 233, 63–68, Feb. 3, 1995.

Chernozatonskii et al., Nanotube Carbon Structure Tips—A Source of High Field Emission of Electrons, *Mat. Res. Soc. Symp. Proc.,* 359, 99–104, 1995 no month data.

B. H. Fishbine et al., Buckytube Cold Field Emitter Array Cathode Experiments, *Mat. Res. Soc. Symp. Proc.,* 359, 93–98, 1995 no month data.

Kratschmer et al., Solid C60: A New Form of Carbon, *Nature,* vol. 347, 354–358, Sep. 27, 1990.

Walt A. de Heer et al., Carbon Onions Produced By Heat Treatment of Carbon Soot and Their Relation To The 217.5 nm Interstellar Absorption Feature, *Chemical Physics Letters,* 207, 480–486, May 28, 1993.

D. Urgate, High–Temperature Behaviour of "Fullerene Black", *Carbon,* vol. 32, No. 7, 1245–1248, 1994 No month data.

Davanloo et al., Laser Plasma Diamond, *J. Mater. Res.,* vol. 5, No. 11, 2398–2404, Nov., 1990.

*Primary Examiner*—Roy V. King

[57] ABSTRACT

A process for making a field emitter cathode is disclosed, which comprises the steps of depositing a solution of a metal compound in a solvent and an electron emitting powder onto the surface of a substrate and heating the substrate containing the solution and the electron emitting powder deposited thereon for a time and temperature sufficient for the metal compound to be completely reduced to a metal.

12 Claims, 3 Drawing Sheets

PROCESS FOR MAKING A FIELD EMITTER CATHODE USING A PARTICULATE FIELD EMITTER MATERIAL

CROSS-REFERENCE TO RELATED APPLICATIONS

This application claims the benefit of U.S. Provisional Application No. 60/006,747, filed Nov. 15, 1995 and PCT International Application PCT/US96/18145, filed Nov. 13, 1996, wherein the United States was a designated country.

FIELD OF THE INVENTION

The invention generally relates to a process for attaching an electron field emitter particulate material to a substrate. In particular, the invention relates to a process for forming a thin metal layer to attach electron field emitter particulate material to a substrate thereby producing a field emitter cathode.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, klystrons and lighting devices.

Display screens are used in a wide variety of applications such as home and commercial televisions, laptop and desktop computers and indoor and outdoor advertising and information presentations. Flat panel displays are typically only a few inches thick in contrast to the deep cathode ray tube monitors found on most televisions and desktop computers. Flat panel displays are a necessity for laptop computers, but also provide advantages in weight and size for many of the other applications. Currently laptop computer flat panel displays use liquid crystals which can be switched from a transparent state to an opaque state by the application of small electrical signals. It is difficult to reliably produce these displays in sizes larger than that suitable for laptop computers.

Plasma displays have been proposed as an alternative to liquid crystal displays. A plasma display uses tiny pixel cells of electrically charged gases to produce an image and requires relatively large electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth, weight and power consumption advantages of the other flat panel displays. U.S. Pat. Nos. 4,857,799 and 5,015,912 disclose matrix-addressed flat panel displays using micro-tip cathodes constructed of tungsten. molybdenum or silicon. WO 94-15352, WO 94-15350 and WO 94-28571 disclose flat panel displays wherein the cathodes have relatively flat emission surfaces.

Certain materials exhibiting electron field emission are readily produced as powders (i.e., particulate material). In order to use such electron emitting powder materials in an electron field emitter cathode it is necessary to attach the particulate emitting material to a substrate so that it is anchored to the substrate without significantly decreasing the emission properties of particulate material.

Clearly, what is needed is a process for making a field emitter cathode using a particulate field emitter material.

Other objects and advantages of the present invention will become apparent to those skilled in the art upon reference to the attached figures and detailed description of the invention which hereinafter follows.

SUMMARY OF THE INVENTION

The present invention provides a process for making a field emitter cathode utilizing electron emitting particulate material (i.e., powder) by attaching said particulate material to a substrate using an electron transporting material. Preferably, the electron transporting material comprises a thin metal layer.

In another aspect of the invention, the invention provides a process for making a field emitter cathode utilizing electron emitting particulate material (i.e., powder). The process comprises the steps of:

a. depositing a solution of a metal compound in a solvent and an electron emitting powder onto the surface of the substrate, the metal compound chosen because it is readily reduced to the metal, and b. heating the substrate with the solution and the electron emitting powder deposited thereon to reduce the metal compound to the metal, with the temperature and the time of heating chosen to result in the complete reduction of the metal compound.

The resulting product is a substrate coated with a thin layer of the metal with an electron emitting powder embedded therein and protruding therefrom. The electron emitting powder is anchored to the substrate and the resulting product is suitable for use as a field emitter cathode.

Preferred is the use of a carbon electron emitting powder. Especially preferred is the use of electron emitting powders of graphite, micronized coke, charcoal, polycrystalline diamond, nanotube carbon structures such as buckytubes, and annealed carbon soot.

The field emitter cathodes of the invention are useful in vacuum electronic devices, flat panel computer and television displays, emission gate amplifiers, klystrons and lighting devices. The panel displays can be planar or curved.

DETAILED DESCRIPTION OF THE PREFERRED EMBODIMENTS

Figure 1:
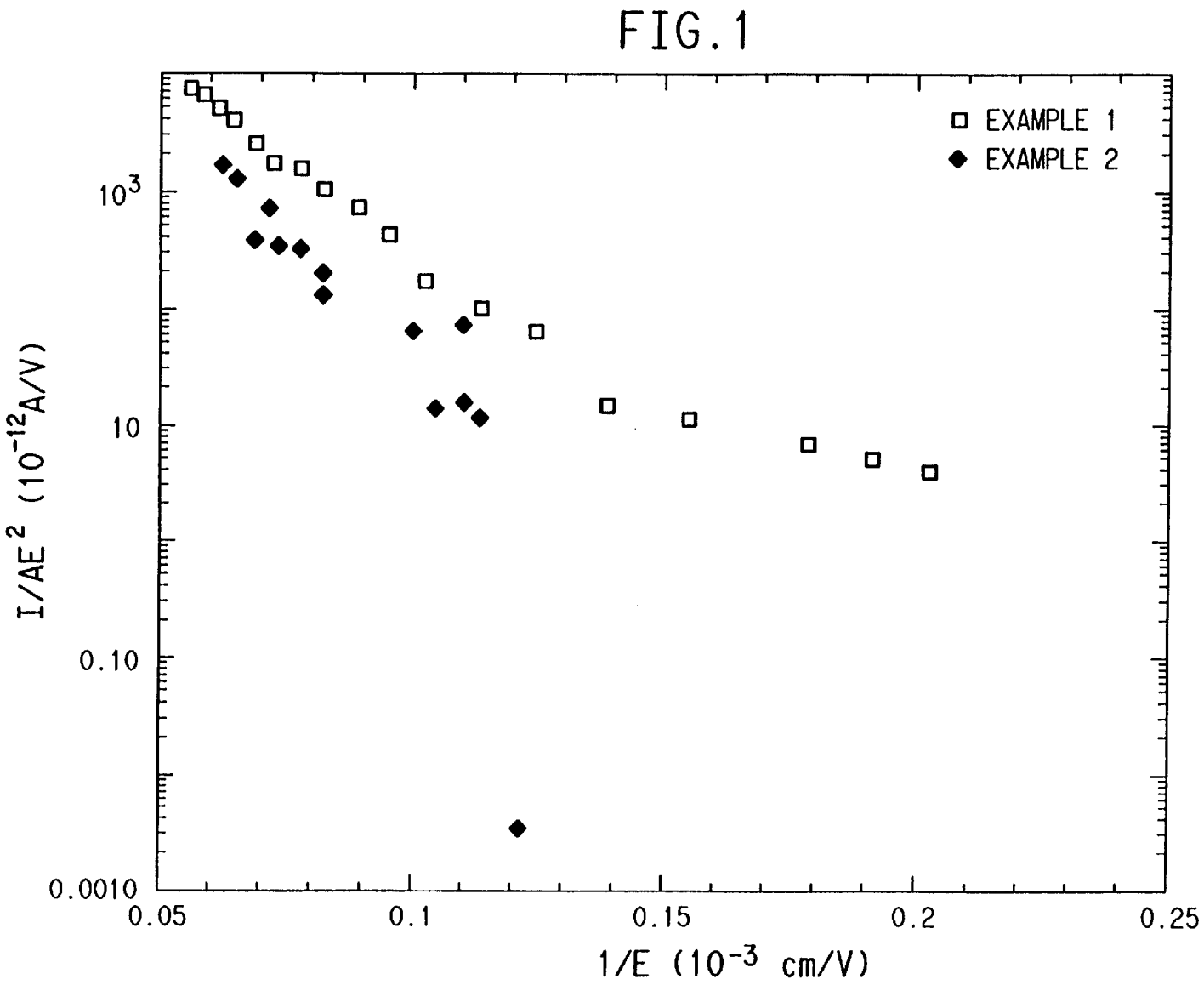
FIG. 1 shows the Fowler-Nordheim plots of the electron emission results for Examples 1 and 2.

As used herein, "powder" means material in a finely divided state, i.e., particulate material, with a particle size less than about 20 $\mu$m. The powder used in the inventive process preferably has a particle size less than about 10 $\mu$m. In some cases, the powder may be "nanoparticulate" meaning that the particulate powder has a particle size in the nanometer range (i.e., less than 1 $\mu$m).

As used herein, "diamond-like-carbon" means that the carbon processes appropriate short range order, i.e., a suitable combination of $sp^2$ and $sp^3$ bonding may also provide for field emission materials with high current densities. By "short range order" is generally meant an ordered arrangement of atoms less than about 10 nanometers (nm) in any dimension.

The electron emitting powder is attached to the surface of an electrically conducting substrate to form a field emitter cathode. The substrate may be of any shape, e.g., a plane, a fiber, a metal wire, etc. The means of attachment must withstand and maintain its integrity under the conditions of apparatus manufacture into which the field emitter cathode is placed, and under the conditions surrounding its use, e.g. typically vacuum conditions and temperatures up to about 450° C. As a result, organic materials are not generally applicable for attaching the particles to the substrate and the poor adhesion of many inorganic materials to carbon further limits the choice of materials that can be used. Moreover, the attachment material must also be capable of transporting charge (electrons) from the substrate to the particulate emitter material.

In one aspect of the present invention provides a process for attaching electron emitting powder to a substrate by creating a thin metal layer of a metal, such as gold or silver, on the substrate with the electron emitting powder particles embedded in the thin metal layer. The thin metal layer anchors the electron emitting powder particles to the substrate. In order for an electron emitting powder particle to be effective as an electron emitting cathode it is necessary to have at least one surface of the particle exposed, i.e., be free of metal and protrude from the thin metal layer. The surface of the cathode should be comprised of the surfaces of an array of electron emitting powder particles with the metal filling the interstices between the particles. The quantity of electron emitting powder particles and the thickness of the metal layer must be chosen to promote the formation of such a surface. In addition to providing means to attach the electron emitting powder particles to the substrate, the conducting metal layer also needs to provide means to apply a voltage to the electron emitting powder particles.

A process for accomplishing this result comprises depositing a solution of a metal compound in a solvent (e.g., water) and electron emitting powder particles onto the surface of a substrate. Other suitable solvents, depending on the metal compound used, may include methanol, isopropanol, methyl ethyl ketone, cyclohexanone, toluene, benzene, and methylene chloride. The solution can be applied to the surface of the substrate first and the electron emitting powder particles then deposited or the electron emitting powder particles can be dispersed in the solution which is then applied to the surface. The metal compound is one which is readily reduced to the metal, e.g., silver nitrate, silver chloride, silver bromide, silver iodide or gold chloride. The metal itself can also be dispersed in an organic binder material which is decomposed and, therefore, eliminated upon heating. In many instances it will be desirable to increase the viscosity of the solution by adding an organic binder material so that the solution readily remains on the substrate. Examples of such viscosity modifiers include polyethylene oxide, polyvinyl alcohol and nitrocellulose.

The substrate with the solution and the electron emitting powder particles deposited on it is then heated to reduce the metal compound to the metal. When an organic binder material is used, it is boiled away (decomposed) during such heating. The temperature and the time of heating are chosen to result in the complete reduction of the metal compound. Typically, reduction is carried out at temperatures from about 120° C. to about 220° C. A reducing atmosphere or air can be used. Typically, the reducing atmosphere used is a 98% argon and 2% hydrogen mixture and the gas pressure is about 5–10 psi ($3.5–7\times10^4$ Pa).

The product is a substrate coated with a thin layer of the metal with the electron emitting powder embedded therein and anchored to the substrate. Such a product is suitable for use as a field emitter cathode.

The substrate may be of any shape, e.g., a plane, a fiber, a metal wire, etc. Suitable metal wires include nickel, tungsten and copper.

In addition, any material in powder form which exhibits electron field emission can be used in this process. Carbon powders and especially powders of graphite, micronized coke, charcoal, polycrystalline diamond, nanotube carbon structures such as buckytubes, and annealed carbon soot are preferred.

Polycrystalline diamond powder prepared by shock synthesis is a preferred carbon powder useful in the invention. "Shock synthesis" means a synthesis in which a shock wave, i.e., a compressional or detonation wave, is used to provide the pressure necessary for synthesis. When an explosion is used to provide the pressure, the synthesis can occur within material which is subjected to the pressure or within the explosive material itself. Examples include Mypolex® diamond powders commercially available from E. I. du Pont de Nemours and Company, Wilmington, Del. Other methods and additional detail are provided in provisional Application No. 60/006,748 entitled "Diamond Powder Field Emitters and Field Emitter Cathodes Made Therefrom" filed simultaneously herewith, the contents of which are incorporated herein by reference.

Field emission has also been observed in two kinds of nanotube carbon structures and powders of these nanotubes can be used in the process of this invention. L. A. Chemozatonskii et al., Chem. Phys. Letters 233, 63 (1995) and Mat. Res. Soc. Symp. Proc. Vol 359, 99 (1995) have produced films of nanotube carbon structures on various substrates by the electron evaporation of graphite in $10^{-5}$–$10^{-6}$ Torr. These films consist of aligned tube-like carbon molecules standing next to one another. Two types of tube-like molecules are formed; the Atubelites whose structure includes single-layer graphite-like tubules forming filaments-bundles 10–30 nm in diameter and the B-tubelites, including mostly multilayer graphite-like tubes 10–30 nm in diameter with conoid or dome-like caps. The authors report considerable field electron emission from the surface of these structures and attribute it to the high concentration of the field at the nanodimensional tips. B. H. Fishbine et al., Mat. Res. Soc. Symp. Proc. Vol 359, 93 (1995) discuss experiments and theory directed towards the development of a buckytube (i.e., a carbon nanotube) cold field emitter array cathode.

Annealed carbon soot powder can also be used in the process of this invention. The carbon soot is generated by the condensation of electric-arc produced carbon vapor in a low pressure inert atmosphere as described in Kratschmer et al., Nature (London) 347, 354 (1990), W. A. de Heer & D. Ugarte, Chem. Phys. Letters 207, 480 (1993) and D. Ugarte, Carbon 32; 1245 (1994). Typically, the carbon soot used in the examples of the invention was prepared in a controlled pressure reaction chamber containing two carbon electrodes. The diameter of the cathode is typically from about 9 mm to about 13 mm and that of the anode from about 6 mm to about 8 mm (the cathode diameter is always larger than the anode diameter). Inert gas such as helium or argon is passed through the chamber and the pressure is held constant at a level from about 100 torr to about 1000 torr. The electric current between the electrodes depends on the electrode diameters, the gap distance between the electrodes and the inert gas pressure. The current is typically between about 50 A and 125 A. A computer-controlled motor is used to adjust the position of the anode relative to the cathode to establish a gap distance of about 1 mm. During the arc-discharge process, the anode is continually consumed.

Carbon is deposited on the cathode and large amounts of carbon soot are deposited on the walls of the reaction vessel and on the filter arranged to trap and collect the carbon soot before it is transported to the pump with the inert gas. Carbon soot is collected from the filter and the walls and fullerenes, such as $C_{60}$ and $C_{70}$, are extracted from the collected carbon soot by solvents such as toluene or benzene. The carbon soot is then annealed to produce annealed carbon soot which is useful as an electron field emitter. The carbon soot is heated at high temperatures in an inert atmosphere to produce the desired change in structure and properties. Annealing at temperatures of 2000° C. to 2400° C. is described by W. A. de Heer & D. Ugarte. Chem. Phys. Letters 207, 480 (1993) and D. Ugarte, Carbon 32, 1245 (1994). The carbon soot is heated to temperatures of at least about 2000° C., preferably at least about 2500° C. and most preferably at least about 2850° C. in an inert atmosphere such as argon or helium. This temperature is preferably maintained for at least about 5 minutes. Temperatures up to about 3000° C. or more can be used although higher temperature may be impractical and are thus less preferred (e.g., loss of material due to evaporation).

The carbon soot can be heated to an intermediate temperature and maintained at that temperature to form a glassy material before raising the temperature to the highest temperature. The emissive properties of the annealed carbon soot thus produced are determined primarily by the highest temperature of the annealing treatment and by the time at that temperature. The annealing process causes a substantial change in the microstructure of the carbon soot. The process produces highly ordered polyhedral nanoparticles about 5 nm to about 15 nm in size. Additional detail and description as provided in provisional Application No. 60/006,766 entitled "Annealed Carbon Soot Field Emitters and Field Emitter Cathodes Made Therefrom" filed simultaneously herewith, the contents of which are incorporated herein by reference.

When the substrate was planar, emission measurements were carried out on samples prepared according to the process of the invention using a flat-plate emission measurement unit comprised of two electrodes, one serving as the anode or collector and the other serving as the cathode. This will be referred to in the Examples as Measurement Unit I. The unit was comprised of two square copper plates, 1.5 in by 1.5 in (3.8 cm×3.8 cm), with all comers and edges rounded to minimize electrical arcing. Each copper plate was embedded in a separate polytetrafluoroethylene (PTFE) block. 2.5 in×2.5 in (4.3 cm×4.3 cm), with one 1.5 in by 1.5 in (3.8 cm×3.8 cm) copper plate surface exposed on the front side of the PTFE block. Electrical contact to the copper plate was made by a metal screw through the back of the PTFE block and extending into the copper plate, thereby providing a means to apply an electrical voltage to the plate and means to hold the copper plate firmly in place. The two PTFE blocks were positioned with the two exposed copper plate surfaces facing one another and in register with the distance between the plates fixed by means of glass spacers placed between the PTFE blocks but distanced from the copper plates to avoid surface leakage currents or arcing. The separation distance between the electrodes can be adjusted, but once chosen, it is fixed for a given set of measurements on a sample. Typically, separations of from about 0.04 cm to about 0.2 cm were used.

In order to measure the emission properties of a sample, the sample was placed on the copper plate serving as the cathode. A negative voltage was applied to the cathode and the emission current was measured as a function of the applied voltage. Since the separation distance between the plates d and the voltage V were measured, the electric field E could be calculated (E=V/d) and the current could be plotted as a function of the electric field.

Another emission measurement unit (referred to in the Examples as Measurement Unit II) was used when wires or fibers were employed as the substrate. Electron emission from wires having attached particulate material was measured in a cylindrical test fixture. In this fixture, the conducting wire to be tested (cathode) was mounted in the center of a cylinder (anode). This anode cylinder typically consisted of a fine mesh cylindrical metal screen coated with a phosphor. Both the cathode and anode were held in place by an aluminum block with a semi-cylindrical hole cut therein.

The conducting wire was held in place by two 1/16 inch-diameter stainless steel tubes, one at each end. These tubes were cut open at each end, forming an open trough in the shape of a half cylinder of length ½ inch and diameter 1/16 inch, and the wire was placed in the open trough that results and held in place with silver paste. The connecting tubes were held in place within the aluminum block by tight fitting polytetrafluoroethylene (PTFE) spacers, which served to electrically separate the anode and cathode. The total length of exposed wire was generally set at 1.0 cm, although shorter or longer lengths could be studied by controlling the placement of the holder tubes. The cylindrical screen mesh cathode was placed in the semi-cylindrical trough in the aluminum block and held in place with copper tape. The cathode was in electrical contact with the aluminum block.

Electrical leads were connected to both the anode and cathode. The anode as maintained at ground potential (0 V) and the voltage of the cathode was controlled with a 0–10 kV power supply. Electrical current emitted by the cathode was collected at the anode and measured with an electrometer. The electrometer was protected from damaging current spikes by an in-series 1 MΩ resistor and in-parallel diodes which allowed high current spikes to bypass the electrometer to ground.

Samples for measurement of length about 2 cm were cut from longer lengths of processed wires. With the flexible stainless steel screen with phosphor removed, they were inserted into the cylindrical troughs of the two holder arms. Silver paste was applied to hold them in paste. The silver paste was allowed to dry and the phosphor screen was reattached and held in place with conductive copper tape at the two ends. The test apparatus was inserted into a vacuum system, and the system was evacuated to a base pressure below about $3\times10^{-6}$ torr.

Emission current was measured as a function of applied voltage. Electrons emitted from the cathode create light when they strike the phosphor on the anode. The distribution and intensity of electron emission sites on the coated wire were observed by the pattern of light created on the phosphor/wire mesh screen. The average electric field E at the wire surface was calculated through the relationship $E=V/[a \ln (b/a)]$, where V was the voltage difference between the anode and cathode, a was the wire radius, and b was the radius of the cylindrical wire mesh screen.

The following non-limiting examples are provided to further illustrate describe, and enable the invention. In the following examples, the flat-plate emission measurement unit or the coated wire emission measurement unit described above were used to obtain emission characteristics for the materials.

EXAMPLE 1

A method for attaching annealed carbon soot particles to a substrate to provide a field emitter cathode is described in this example wherein annealed carbon soot particles were attached to a 100 nm film of silver which was sputtered onto a glass slide.

Annealed carbon soot was prepared for use in Example 1. Carbon soot was prepared by using graphite electrodes with diameters of 8 mm and 12 mm for the anode and cathode, respectively. The atmosphere in the chamber was helium at a pressure of about 150 torr and the current between the electrodes during the arc-discharge experiment was about 125 amps. A computer-controlled motor was used to adjust the position of the anode with respect to the cathode. During the arc-discharge process, the anode was consumed, a carbonaceous growth occurred on the cathode, and the motor controls the distance between the anode and the cathode to approximately 1 mm, maintaining a voltage of 20 to 30 volts between the electrodes. Carbon soot was deposited on the walls of the chamber, from where it is scraped off, and on a filter placed en route to a pump that controlled the chamber pressure, from where it was collected. The soot from the chamber walls and from the filter was annealed to produce the emissive material.

The annealing process used to produce the annealed carbon soot used in Example 1 was as follows. The carbon soot was placed in a graphite crucible and heated in flowing argon. The temperature was increased at a rate of 25° C. per minute to 2850° C. The soot was maintained at 2850° C. for 15 minutes and then cooled in the furnace to room temperature. The furnace used normally took about an hour to cool to room temperature and the annealed carbon soot was then removed from the furnace.

A 100 nm silver film was sputtered onto a 1 in×0.5 in (2.5 cm×1.3 cm) glass slide. The silver was sputtered at a deposition rate of 0.4 nm/s in an argon atmosphere using a Denton 600 (Denton Company, Cherry Hill, N.J.) sputtering unit. The glass slide containing the sputtered silver film served as the substrate for the annealed carbon soot field emission particles.

A solution containing 25 wt % silver nitrate ($AgNO_3$), 3 wt % polyvinyl alcohol (PVA) and 71.9 wt % water was prepared by adding 3 g of PVA, M.W. 86,000, (Aldrich, Milwaukee, Wis.) to 72 g of boiling $H_2O$ and stirring for about 1 hour to completely dissolve the PVA. 25 g of $AgNO_3$ (EM Science, Ontario, N.Y.) were added to the PVA solution at ambient temperature and the solution was stirred to dissolve the $AgNO_3$. 0.1 wt % of a fluorinated surfactant, ZONYL® FSN (E. I. du Pont de Nemours and Company, Wilmington, Del.) was also added to the solution to improve the wetting of the solution to, the silver film.

The PVA/$AgNO_3$/ZONYL® FSN solution was applied to the silver film using a #3 wire rod (Industry-Technology, Oldsmar. Fla.). The annealed carbon soot powder was sprinkled through a 0.11 mil (30 micron) silk screen uniformly onto the wet PVA/$AgNO_3$/ZONYL® FSN surface. When the surface was completely covered with annealed carbon soot, the glass slide substrate containing the wet PVA/$AgNO_3$/ZONYL® FSN film covered with annealed carbon soot was placed in a quartz boat which was then positioned in the center of a tube furnace. Heating was carried out in a reducing atmosphere comprised of 2% hydrogen and 98% argon. The temperature was increased at a rate of 14° C. per minute to 140° C. and this temperature was maintained for one hour. The sample was allowed to cool to room temperature in the furnace in the same reducing atmosphere and was then removed from the furnace. The reduced silver metal provided a thin silver film layer which attached and anchored the annealed carbon soot particles to the sputtered silver film of the substrate and resulted in an electron emitter which was suitable for use as a field emitter cathode. The electron emission of the electron emitter was measured using the flat-plate emission measurement unit described previously as Measurement Unit I.

FIG. 1 shows the well-known Fowler-Nordheim plot of the emission results for this sample (Example 1) which were measured with an electrode separation distance of 2.49 mm.

EXAMPLE 2

A method for attaching graphite particles (graphite powder) to a substrate to provide a field emitter cathode is described in this Example wherein graphite particles were attached to a 100 nm film of silver which was sputtered onto a glass slide.

A 100 nm silver film was sputtered onto a 1 in×3 in (2.5 cm×7.6 cm) glass slide. The silver was sputtered at a deposition rate of 0.4 nm/s in an argon atmosphere using a Denton 600 (Denton Co., Cherry Hill, N.J.) sputtering unit. The glass slide containing the sputtered silver film served as the substrate for the graphite field emission particles.

A solution containing 25 wt % silver nitrate ($AgNO_3$), 3 wt % polyvinyl alcohol (PVA) and 72 wt % water was prepared by adding 3 g of PVA, M.W. 86,000, (Aldrich, Milwaukee, Wis.) to 72 g of boiling $H_2O$ and stirred for about 1 hour to completely dissolve the PVA. 25 g of $AgNO_3$(EM Science, Ontario, N.Y.) were added to the PVA solution at ambient temperature and the solution was stirred to dissolve the $AgNO_3$.

The PVA/$AgNO_3$ solution was applied to the silver film using a #3 wire rod (Industry Technology, Oldsmar, Fla.). The graphite powder (commercially available from Aesar, Ward Hill, Mass.) was sprinkled through a 0.11 mil (30 micron) silk screen uniformly onto the wet PVA/$AgNO_3$ surface. When the surface was completely covered with graphite powder, the glass slide substrate containing the wet PVA/AgNO; film covered with graphite powder was placed in a quartz boat which was then positioned in the center of a tube furnace. Heating was carried out in a reducing atmosphere comprised of 2% hydrogen and 98% argon. The temperature was increased at a rate of 14° C. per minute to 140° C. and this temperature was maintained for one hour. The sample was allowed to cool to room temperature in the furnace in the same reducing atmosphere and was then removed from the furnace. The reduced silver metal provided a thin silver film layer which attached and anchored the graphite powder to the sputtered silver film of the substrate and resulted in an electron emitter which was suitable for use as a field emitter cathode. The electron emission of the electron emitter was measured using the flat-plate emission measurement unit (Measurement Unit I) described previously.

FIG. 1 shows the well-known Fowler-Nordheim plot of the emission results for h sample (Example 2) which were measured with an electrode separation distance of 2.49 mm. As shown in FIG. 1, the emissivity of the annealed carbon soot (Example 1) is slightly higher than that of graphite powder (Example 2).

EXAMPLES 3–5

A method is described in these examples for attaching annealed carbon soot particles to a metal wire using a thin silver layer and thereby providing a field emitter cathode. Annealed carbon soot was prepared as described in Example 1 and was used in Examples 3–5 as set forth below.

The metal wires used in these examples to support the annealed carbon soot were all cleaned by immersing them in a 5% $HNO_3$ solution for one minute followed by rinsing with abundant water and then rinsing with acetone and methanol.

In Example 3, a solution containing 25 wt % silver nitrate ($AgNO_3$ ), 3 wt % polyvinyl alcohol (PVA) and 72 wt % water was prepared by adding 3 g of PVA, M.W. 86,000, (Aldrich, Milwaukee, Wis.) to 72 g of boiling $H_2O$ and stirring for about 1 hour to completely dissolve the PVA. 25 g of $AgNO_3$ (EM Science. Ontario, N.Y.) were added to the PVA solution at ambient temperature and the solution was stirred to dissolve the $AgNO_3$.

A 4 mil (100 $\mu$m) copper wire was immersed in the PVA/$AgNO_3$ solution and then immersed in the annealed carbon soot. When the surface of the copper wire was completely covered with annealed carbon soot, the wire was placed in a quartz boat which was then positioned in the center of a tube furnace.

In Examples 4 and 5, a solution containing 25 wt % silver nitrate ($AgNO_3$), 3 wt % polyvinyl alcohol (PVA), 0.5 wt % of a fluorinated surfactant. ZONYL® FSN and 71.5 wt % water was prepared by adding 3 g of PVA, M.V. 86.000, (Aldrich, Milwaukee. Wis.) to 71.5 g of boiling $H_2O$ and stirring for about 1 hour to completely dissolve the PVA. 25 g of $AgNO_3$ (EM Science, Ontario, N.Y.) were added to the PVA solution at ambient temperature and the solution was stirred to dissolve the $AgNO_3$. 0.5 g of ZONYL® FSN was added to the solution to improve the wetting of the solution to the wire.

In Example 4, a 4 and (100 $\mu$m) copper wire was immersed in the PVA/$AgNO_3$/ZONYL® FSN solution and then immersed in the annealed carbon soot. When the surface of the wire was completely covered with annealed carbon soot, the wire was placed in a quartz boat which was then positioned in the center of a tube furnace.

In Example 5, a 4 mil (100 $\mu$m) copper wire was immersed in the PVA/$AgNO_3$/ZONYL® FSN solution and then immersed in the annealed carbon soot. When the surface of the wire was completely covered with annealed carbon soot, a thin liquid coating of the PVA/$AgNO_3$/ZONYL® FSN solution used in Example 1 was used to coat the annealed carbon soot particles using a nebulizer head (Model 121—Sono-Tek Corporation. Poughkeepsie, N.Y.) that produced a fine mist comprised of micron diameter droplets. The solution was delivered to the nebulizer head by a syringe pump at the rate of 18 $\mu$L/s for about 30 seconds. During the time of deposition, the wire was translated and rotated to provide uniform coverage with the solution. The wire was then placed in a quartz boat which was positioned in the center of a tube furnace.

In all three examples, firing was carried out in a reducing atmosphere comprised of 2% hydrogen and 98% argon. The temperature was increased at a rate of 14° C. per minute to 140° C. and this temperature was maintained for one hour. Each sample was allowed to cool to room temperature in the furnace in the same reducing atmosphere and was then removed form the furnace. In each example, the reduced silver metal provided a thin silver film layer which coated the wire and attached the annealed carbon soot to the wire and resulted in an electron emitter which was suitable for use as a field emitter cathode. The electron emission was measured using the cylindrical emission measurement unit described previously as Measurement Unit II.

Figure 2:
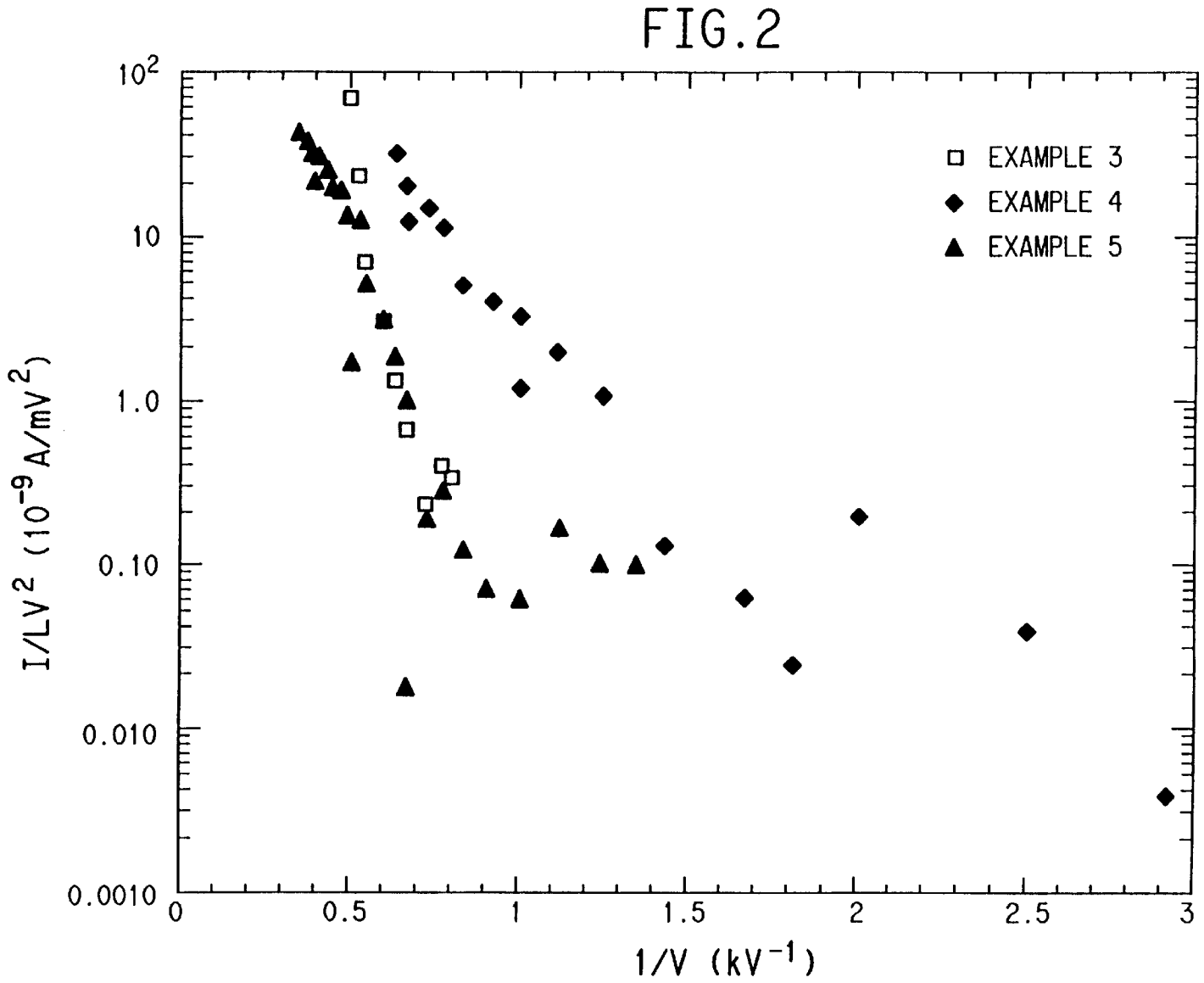
FIG. 2 shows the Fowler-Nordheim plots of the electron emission results for Examples 3, 4, and 5.

FIG. 2 shows the well-known Fowler-Nordheim plots of the emission results for these samples (Examples 3–5). The data shows that Example 4 shows higher emission, presumably due to higher particle density on the wire due to higher $AgNO_3$ wetting to the copper wire which, in-turn, allows more particles to adhere to the wire surface. Example 5 shows that top coating decreases the emissivity of the particles although it increases the anchoring effect of the particles to the wire.

EXAMPLES 6–10

A method is described in these examples for attaching annealed carbon soot particles and micronized graphite particles to metal wires using a thin gold layer, thereby providing a field emitter cathode. The annealed carbon soot was prepared substantially as in Example 1.

The wires used in these examples were all cleaned by immersing them in a 3% $HNO_3$ solution for one minute followed by rinsing with abundant water and then rinsing with acetone and methanol.

In Example 6, gold dispersed in an organic base (Aesar 12943, Ward Hill, Mass.) was brushed onto a 5 mil (125 $\mu$m) tungsten wire according to the manufacturer's suggestions. Annealed carbon soot was deposited onto the wire covered with the gold dispersion through a 100 micron sieve. When the surface of the wire was completely covered with annealed carbon soot, the wire was placed in a quartz boat which was then placed in a furnace.

Heating was carried out in an atmosphere of air. The temperature was increased at a rate of 25° C. per minute to 540° C. and this temperature was maintained for 30 minutes to bum off all organic materials. The sample was allowed to cool to room temperature in the furnace and was then removed from the furnace. The gold metal provided a thin gold film layer which coated the wire and attached the annealed carbon soot particles to the wire and resulted in an electron emitter which was suitable for use as a field emitter cathode.

In Example 7, a sample was prepared essentially as described for Example 6 except that after the sample was removed from the furnace, a 50 nm layer of diamond-like carbon was deposited on the surface to further seal the structure by laser ablation of a graphite target. Additional description on coating a fiber or wire with diamond-like-carbon via laser ablation can be found in Davanloo et al., J. Mater. Res., Vol. 5, No. 11, November 1990 and in U.S. Pat. No. 5,578,901. (Blanchet-Fincher et al.) entitled "Diamond Fiber Field Emitters", the entire contents of which are incorporated herein by reference. A 264 nm wave length laser beam was used to make an incident angle of 45° to a graphite target located at the center of the ablation chamber. Laser pulses of 10 nanoseconds with a 2 Hz repetition rate were used. An energy density of 4 J/cm$^2$ was maintained for 1 minute and the laser beam was rastered onto the target with a pair of motorized micrometers. The ablation chamber was maintained at $2\times10^{-7}$ torr ($2.67\times10^5$ Pascal). The wire used was 5 cm away from the target along the direction normal to the target.

In Example 8, a sample was prepared essentially as described for Example 6 except that a 4 mil (100 $\mu$m) copper wire was used in place of the tungsten wire.

In Example 9, a sample was prepared essentially as described for Example 6 except that calcined/micronized coke (available as Conoco 901190 from Conoco, Inc., Houston, Tex.) was used instead of annealed carbon soot and a 3 mil (75 $\mu$m) copper wire coated with a fluorinated solvent, ZONYL® FSN (E. I. du Pont de Nemours and Company, Wilmington, Del.), was used in place of the tungsten wire. After the wire was coated with gold dispersion, it was immersed in calcined/micronized coke to completely cover the wire.

In Example 10, a sample was prepared essentially as described for Example 9 except that when the surface of the wire was completely covered with calcined/micronized coke, and before heating, a thin liquid coating of a 2 wt % gold and 98 wt % cyclohexane solution was deposited using a nebulizer head (Model 121—Sono-Tek Corporation, Poughkeepsie, N.Y.) that produced a fine mist comprised of micron diameter droplets. The solution was delivered to the nebulizer head by a syringe pump at the rate of 18 $\mu$L/s for about 30 seconds. During the time of deposition, the wire was translated and rotated to provide uniform coverage with the solution. The wire was then placed in a quartz boat which was positioned in the center of a tube furnace.

The electron emission of all samples was measured using the cylindrical emission measurement unit described previously as Measurement Unit II.

Figure 3:
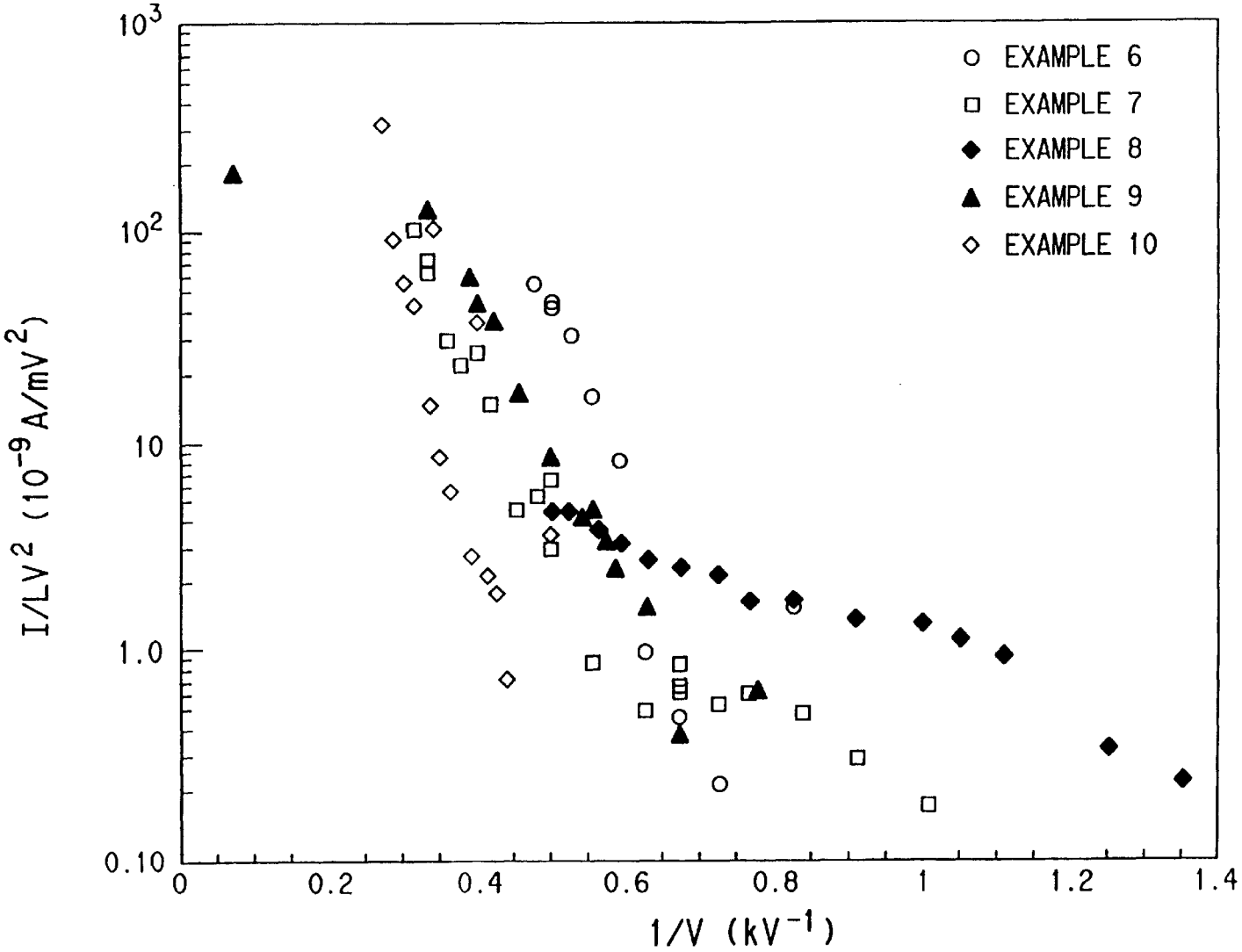
FIG. 3 shows the Fowler-Nordheim plots of the electron emission results for Examples 6, 7, 8, 9, and 10.

The data is shown in FIG. 3 and indicates that emission occurs on different wires with or without top coats.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A process for making a field emitter cathode, comprising the steps of:

(a) depositing a solution of a metal compound in a solvent and an electron emitting powder onto the surface of a substrate, wherein the metal compound is capable of being completely reduced to a metal upon subsequent heating; and (b) heating the substrate containing the solution and the electron emitting powder deposited thereon for a time and temperature sufficient for the metal compound to be completely reduced to the metal.

2. The process of claim 1 wherein the substrate is planar.

3. The process of claim 1 wherein the substrate is a fiber.

4. The process of claim 1 wherein the substrate is a metal wire.

5. The process of claim 4 wherein the metal wire is selected from the group consisting of nickel, tungsten and copper.

6. The process of claim 1 wherein the metal compound is selected from the group consisting of silver nitrate, silver chloride, silver bromide, silver iodide and gold chloride.

7. The process of claim 1 wherein the solvent is water.

8. The process of claim 1 wherein the electron emitting powder is a carbon powder.

9. The process of claim 8 wherein the carbon powder is selected from the group consisting of graphite powder, micronized coke powder, charcoal powder, polycrystalline diamond powder, nanotube carbon powder, and annealed carbon soot powder.

10. The process of claim 1 further comprising adding an organic binder material to the solution to increase the viscosity of the solution.

11. The process of claim 10 wherein the organic binder is selected from the group consisting of polyethylene oxide, polyvinyl alcohol and nitrocellulose.

12. The process of claim 1 wherein heating takes place between about 120 to about 220° C.

* * * * *